United States Patent [19]

Yuasa

[11] Patent Number: 4,641,955

[45] Date of Patent: Feb. 10, 1987

[54] ION PROJECTION RECORDING APPARATUS

[75] Inventor: Kazuhiro Yuasa, Zama, Japan

[73] Assignee: Ricoh Company, Ltd., Tokyo, Japan

[21] Appl. No.: 795,099

[22] Filed: Nov. 5, 1985

[30] Foreign Application Priority Data

Nov. 5, 1984 [JP] Japan ..... 59-231241
Dec. 20, 1984 [JP] Japan ..... 59-267375

[51] Int. Cl.[4] ..... G03G 15/08

[52] U.S. Cl. ..... 355/14 TR; 355/3 DD; 355/14 D; 355/3 TR; 355/3 CH; 355/14 CH; 250/324

[58] Field of Search ..... 355/3 DD, 3 CH, 14 CH, 355/3 SC, 3 TR, 14 TR, 14 D; 250/324, 325, 326

[56] References Cited

U.S. PATENT DOCUMENTS 4,341,457 7/1982 Nakahata et al. ..... 355/3 CH
4,402,591 9/1983 Nakahata ..... 355/3 TR
4,411,512 10/1983 Springer ..... 355/3 TR
4,482,240 11/1984 Kuge et al. ..... 355/3 TR
4,575,216 3/1986 Hebert et al. ..... 355/3 TR

*Primary Examiner*—A. C. Prescott
*Attorney, Agent, or Firm*—Oblon, Fisher, Spivak, McClelland & Maier

[57] ABSTRACT

A recording apparatus for use with a copier, a printer or the like which utilizes an ion projection recording system for recording images on plain papers. Toner is carried by toner transport means and charged to a first polarity, while a transfer member is fed by feeding means to make contact with or come close to the toner layer on the transport means. Ion generating means is located at the opposite side to the charged toner layer with respect to the transfer member and generates ions having a second polarity which is opposite to the polarity of the toner or having both a polarity common to that of the toner and a second polarity opposite to the same. The streams of ions are controlled pixel by pixel by ion stream control means responsive to image data which should be recorded, so that the toner particles are selectively deposited on the transfer member by Coulomb's force which acts between the ions and the charged toner.

15 Claims, 10 Drawing Figures

ION PROJECTION RECORDING APPARATUS

BACKGROUND OF THE INVENTION

The present invention relates to a printer, a plotter or like recording apparatus for recording images in plain papers and others and usable as an output unit of, for example, a copier or a processing system. More particularly, the present invention is concerned with a recording apparatus utilizing a so-called ion projection system which records images by controlling streams of ions on a pixel basis.

An ion projection recording system per ce is well known in the art as disclosed in, for example, Nikkei Electronics, July 5, 1982, pp. 139–140. In this type of recording system, the ion stream is controlled responsive to image data to be recorded so as to provide a latent image electrostatically on the surface of a recording element, or intermediate recording medium, and then the latent image is developed by a developing unit using toner. The resulting toner image is transferred to and then fixed on a transfer member such as a plain paper to provide a hard copy.

As described above, the prior art ion projection recording system needs various processes before recording images on a transfer member, i.e. forming an electrostatic latent image, developing the latent image, transferring the resulting toner image, and fixing the toner image. Such individual processes have to be performed relying on various kinds of means which make the apparatus construction complicated and, therefore, expensive, unreliable and bulky.

SUMMARY OF THE INVENTION

It is therefore an object of the present invention to provide a recording apparatus which utilizing the ion processing recording system allows toner images to be directly formed with high quality on a plain paper or like transfer member.

It is another object of the present invention to provide a generally improved ion projection recording apparatus.

A recording apparatus for recording an image by controlling streams of ions pixel by pixel of the present invention comprises a toner charging and transporting arrangement for charging toner to a first polarity, regulating the charged toner to form a toner layer having a predetermined thickness, and transporting the charged toner layer, an ion generating unit for generating ions having a predetermined polarity poitioned at a side opposite to the charged toner layer with respect to a transfer member which is fed such that a surface of the transfer member is located closed to or in contact with the charged toner layer, and an ion stream control head for controlling streams of the ions generated by the ion generating unit pixel by pixel responsive to image data which are to be recorded, whereby the charged toner is selectively deposited on the transfer member due to coulomb force acting between the ions having the predetermined polarity and the charging toner.

The above and other objects, features and advantages of the present invention will become more apparent from the following detailed description taken with the accompanying drawings.

DESCRIPTION OF THE PREFERRED EMBODIMENTS

While the ion projection recording apparatus of the present invention is susceptible of numerous physical embodiments, depending upon the environment and requirements of use, substantial numbers of the herein shown and described embodiments have been made, tested and used, and all have performed in an eminently satisfactory manner.

Figure 1:
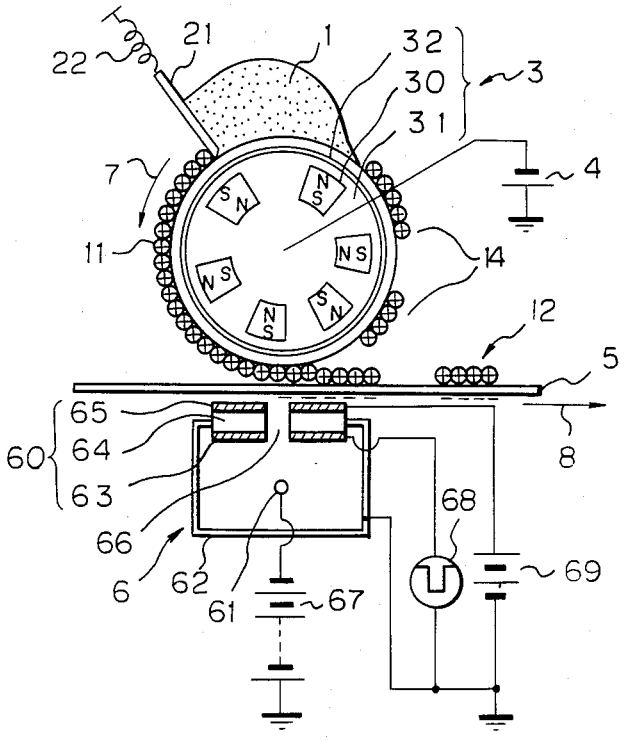
FIG. 1 is a schematic view of a recording apparatus embodying the present invention.

Referring to FIG. 1 of the drawings, a recording apparatus embodying the present invention is schematically shown. The apparatus includes a developing roller 3 adapted to hold and transport toner 1. As shown, the developing roller 3 is made up of a group of fixed magnets 30, and a rotary drum 31 having a cylindrical sleeve 32 and applied with a negative voltage from a power source 4. The drum 31 is driven by a drive source, not shown, in a counterclockwise rotational motion is indicated by an arrow 7. The sleeve 32 may be constituted by a metallic cylindrical portion, which forms part of the drum 31, and conductive rubber which covers the cylindrical portion. The rubber may comprise silicon rubber having a volume resistivity of $10^5$ Ω·cm, a surface roughness of less than 5 μm, and a hardness of 35 HS. The sleeve 32 is biased to negative polarity by the power source 4. A doctor blade 21 is constantly biased by a spring 22 to remain in pressing contact with the sleeve 32 of the developing roller 3. A transfer member such as a plain paper 5 is fed by known feeding means, not shown, to a position below the developing roller 3. In this particular position, the transfer member 5 makes contact with a charged toner layer 11 which is deposited on the surface of the sleeve 32.

An ion stream control head 6 is located at the opposite side to the sleeve 32 with respect to the transfer member 5. As described later in detail, the control head 6 serves to control streams of ions which are charged to the opposite polarity to the charged toner, on a pixel basis in the main scanning direction (in the axial direction of the roller 3 in FIG. 1), thereby causing the toner to be selectively deposited on the transfer member 5. As shown, the control head 6 comprises a corona wire 61 for producing corona ions, a casing 62 which bifunctions as a charger for the corona wire 61, and a control plate 60 which is rigidly mounted to the top of the casing 62. The control plate 60, on the other hand, comprises recording electrodes 63 to which a voltage switched responsive to image data to be recorded are applied, and copntrol electrodes 65 located to face the recording electrodes 63 with the intermediary of an insulating layer 64 and functioning to develop electric fields for controlling ion streams in cooperation with the recording electrodes 63.

Figure 2:
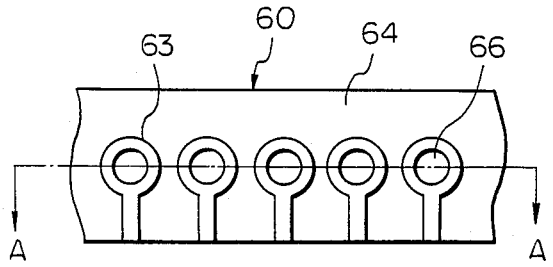
FIG. 2 is a view of an arrangement of recording electrodes which is seen from the corona wire side.
Figure 3:
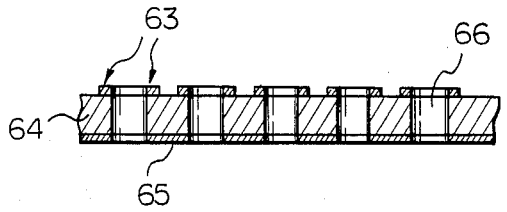
FIG. 3 is a section along line A—A of FIG. 2.

The structure of the control plate 60 as seen from the corona wire 61 side is shown in FIG. 2. The control plate 60 is formed with through bores 66 at equally spaced locations along the main scanning direction. The number of the bores 66 is equal to that of pixels (1728 pixels in the case of eight scanning lines per millimeter and A4 papers). The recording electrodes 63 are formed each in an annular configuration to surround the bores 66 in one-to-one correspondence. As shown in FIG. 3 which is a section along line A—A of FIG. 2, the control electrodes 65 are formed integrally with each other. The bores 66 may naturally be arranged in a zig-zag configuration, instead of the linear arrangement of FIG. 2.

A high-tension power source 67 is connected to between the corona wire 61 and the casing 62 to apply a voltage thereacross which is opposite in polarity to the charged toner layer 11 on the sleeve 32. Connected to each of the recording electrodes 63 of the control plate 60 is a recording power source 68 which is switched responsive to image data to be recorded. Further, connected to the control electrodes 65 is a bias power source 69 adapted to apply a predetermined bias voltage. The recording power source 68 applies to the recording electrodes 63 a voltage lower than the bias voltage applied to the control electrodes 65 when an image is to be recorded in the transfer member 5, and a voltage higher than the latter when an image is not to be recorded.

While the recording power source 68 and bias power source 69 are shown in FIG. 1 as being connected to a single recording electrode 63 and others, it will be seen that they are similarly connected to the other recording electrodes 63 and others.

In operation, the magnetic one-component toner 1 having a high resistance is retained on the sleeve 32 of the developing roller 3 by the magnet group 31. As the roller 3 is rotated by drive means, not shown, in the direction indicated by the arrow 7, the toner 1 on the sleeve 32 is regulated to a predetermined thickness by the doctor blade 21 and, at the same time, charged to a first polarity due to friction between the toner 1 and the sleeve 32 or the doctor blade 21. In this particular embodiment, the first polarity is assumed to be positive (+). While in the illustrative embodiment the thickness regulation and charging of the toner 1 are accomplished by covering the surface of the sleeve 32 with conductive rubber and urging the hard doctor blade 21 strongly against the sleeve 32 by means of the spring 22, such is only illustrative and may be replaced with any other suitable means so long as it is of the kind using ordinary one-component toner whose resistance is relatively high.

The charged toner layer 11 on the surface of the sleeve 32 is substantially 10–50 μm thick and provided with a charge of approximately 3–25 μc/g. While the developing roller 3 is rotated in the direction 7, the toner layer 11 is sequentially brought into contact with or close to the transfer member 5. The transfer means 5 is fed by known feeding means, which may be of the kind generally used with a copier, facsimile terminal or like recording apparatus, in a direction indicated by an arrow 8 so as to make or substantially make contact with the charged toner layer 11 at a position below the developing roller 3.

Meanwhile, the corona wire 61 and the casing 62 of the control head 6, which is positioned below the transfer member 5, develop corona dicharge therebetween and, thereby, generate streams of ions having a second polarity. In this particular embodiment, the second polarity is negative (−). The control electrodes 65 connected to the bias power source 69 and the recording electrodes 63 connected to the switched recording power source 68 cooperate in one-to-one correspondence to develop electric fields therebetween, so that the ion streams are sequentially controlled in the main scanning direction to form a toner image on the transfer member 5.

Figure 4:
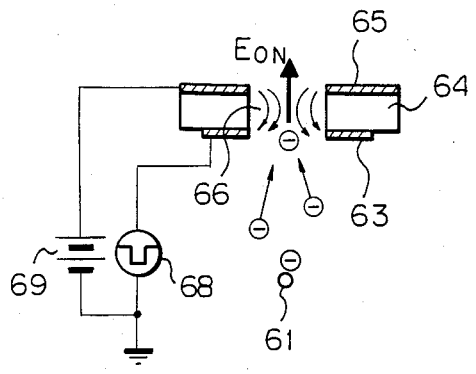
FIG. 4 is a fragmentary section illustrative of a stream of ions being controlled at an ion control head of the recording apparatus of FIG. 1.

The control over the ion streams as mentioned above will be described in detail with reference to FIGS. 4 and 5. As shown in FIG. 4, for each of the pixels which should be recorded in the main scanning direction on the transfer member 5, a voltage lower than the bias voltage applied to the control electrode 65 is applied from the recording power source 68 to the recording electrode 63. In this condition, negative ions generated by corona discharge migrate through the bore 66 of the control plate 66 to negatively charge the lower surface of the transfer member 5 with the result that an electric field develops between the transfer member 5 and the sleeve 32 of the roller 3 for transferring the toner particles from the layer 11 to the upper surface of the transfer member 5. If such an electric field has sufficient intensity, the toner particles will successfully be deposited on the transfer member 5 to form an image.

Figure 5:
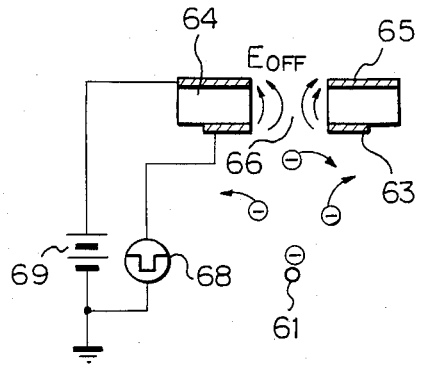
FIG. 5 is a view similar to FIG. 4 but showing an ion stream under a condition in which an image should not be recorded in a transfer member.

As shown in FIG. 5, for each of the pixels which should not be recorded, a voltage higher than the voltage applied to the control electrode 65 is applied to the recording electrode 63. As a result, the negative ions are prevented from migrating through the bore 66 of the control plate 60. This in turn prevents the lower surface of the transfer member 5 from being charged and, therefore, the toner particles from being transferred from the layer 11 to the upper surface of the transfer member 5.

The resulting toner image 12 on the transfer member 5 is conveyed toward a fixing unit which is well known in the art, not shown. Those toner particles 14 left on the sleeve 32 without being transferred to the member 5 are returned to a hopper to be reused for development.

In the illustrative embodiment, the toner is positively charged and the ions generated by corona discharge are negatively charged. Alternatively, the toner may be negatively charged and the ions positive charged, in which case the relationship between the voltages applied to the control electrodes 65 and recording electrodes 63 should be inverted.

While in FIG. 1 the roller 31 and, therefore, the sleeve 32 is supplied with a negative voltage from the power source 4, such is merely to free the sleeve 32 from contamination and, basically, it may be connected to ground.

Although the sleeve 32 has been shown and described as being rotatable, the magnet group 30 may be constructed as an integral magnet group and rotated relative to a stationary sleeve.

The multiple recording electrodes 63 and the multiple bores 66 of the control plate 60 may be replaced with a single recording electrode and a single bore. In such a case, an arrangement may be made such that the recording electrode and bore are movable in the main scanning direction to provide a two-dimensional image.

The one-dimensional arrangement of the bores 66 in the control plate 60 is not limitative and may be replaced by a two-dimensional arrangement. For example, two one-dimensionally staggered bores 66 may be alternately arranged in a zig-zag fashion to provide four rows of bores.

Figure 6:
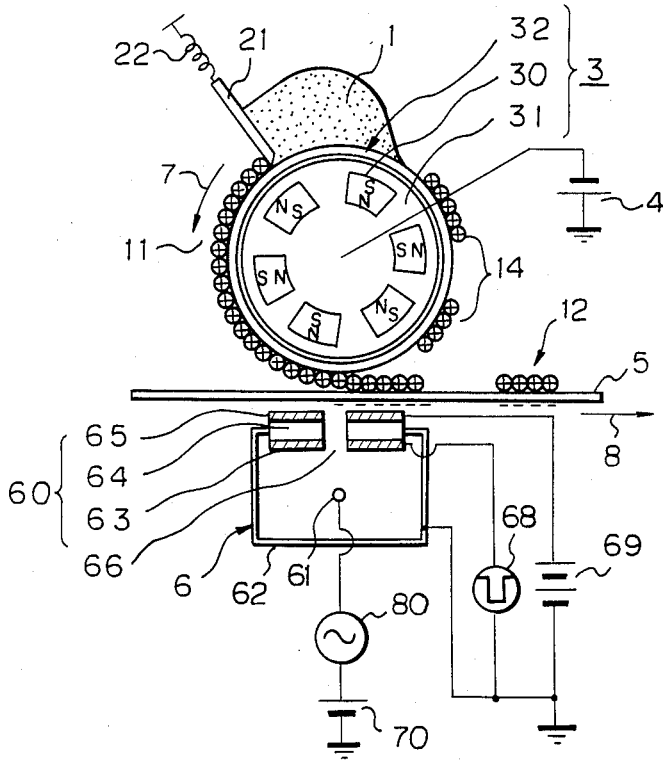
FIG. 6 is a schematic view of a second embodiment of the present invention.

Referring to FIGS. 6–10, another embodiment of the present invention is shown. In FIGS. 6–10, the same or similar structual elements as those shown in FIGS. 1–5 are designated by like reference numerals. The major difference of this particular embodiment from that of FIGS. 1–5 resides in the manner of driving the ion stream control head. Specifically, in this particular embodiment, the control head 6 is constructed to control streams of ions which are charged to the same polarity as the charged toner and those charged to the opposite polarity, on a pixel basis in the main scanning direction (in the axial direction of the developing roller 3). Specifically, as shown in FIG. 6, a DC power source common in polarity to the charged toner layer 11 on the sleeve 32 and an AC high-tension power source 80 are serially connected to between the corona wire 61 and the casing 62 so as to cause corona discharge. This generates not only negative ions (−) but also positive ions (+). Since application of an alternating current usually allows negative ions to ionize more easily than positive ions, this particular embodiment is arranged to superpose an alternating current on the positive DC component. However, the DC power source 70 is omissible inasmuch as negative ions which are essential for toner particles to become deposited on the transfer member 5 are more important than positive ions. In this manner, so long as the recording apparatus is in operation, positive and negative ions are continuously generated by corona discharge which occurs between the corona wire 61 and the casing 62.

In this particular embodiment, streams of positive and negative ions are sequentially controlled in the main scanning direction by electric fields which are produced between the control electrodes 65 and the recording electrodes 63 responsive to image data which should be recorded, thereby producing a toner image on the transfer member 5. One of the two polarities is the same as the polarity of the charged toner particles as previously stated, and the other is opposite to the latter.

Figure 7:
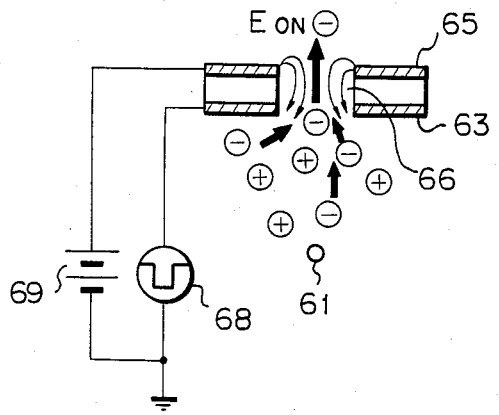
FIG. 7 is a fragmentary section of an ion stream being controlled at an ion control head of the recording apparatus of FIG. 6.

Specifically, as shown in FIG. 7, for each of those pixels which should be recorded on the transfer member 5, a voltage lower than the bias voltage applied to the control electrode 65 is applied to the recording electrode 63 from the recording power source 68. In this condition, an electric field $E_{ON}$ which allows only the negative ions to readily migrate through the bore 66 of the control plate 60 is developed in the bore 66. Only the negative ions, therefore, move through the bore 66 to reach the lower surface of the transfer member 5. As the negative ions charge the lower surface of the transfer member 5 in dots, the positively charged toners are released from the layer 11 to form a toner image 12 on the upper surface of the transfer member 5.

Figure 8:
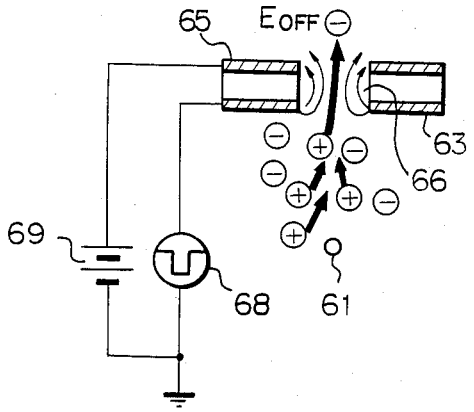
FIG. 8 is a view similar to FIG. 7 but showing an ion stream under a condition in which an image should not be recorded in a transfer member.

Meanwhile, for each of those pixels which should not be recorded, a voltage higher than the bias voltage applied to the control electrode 65 is applied to the recording electrode 63. Consequently, as shown in FIG. 8, an electric field $E_{OFF}$ which allows positive ions to readily pass through the bore 66 is developed in the bore 66. Then, the negative ions are disabled to migrate through the bore 66, while the positive ions move through the bore 66 to the lower surface of the transfer member 5. As the positive ions charge the lower surface of the transfer member 5 in dots, the toner particles in the layer 11 which make contact with and share the same polarity with the transfer member 5 are repulsed and, at the same time, those toner particles which are about to adhere to the background area of the transfer member 5 are returned toward the sleeve 32 of the roller 3. This, coupled wih the previously stated process for providing the toner image 12, provides a high quality image having a desirably large signal-to-noise (S/N) ratio.

Figure 9:
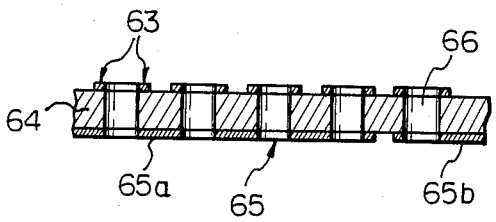
FIG. 9 is a section of a modified control plate.
Figure 10:
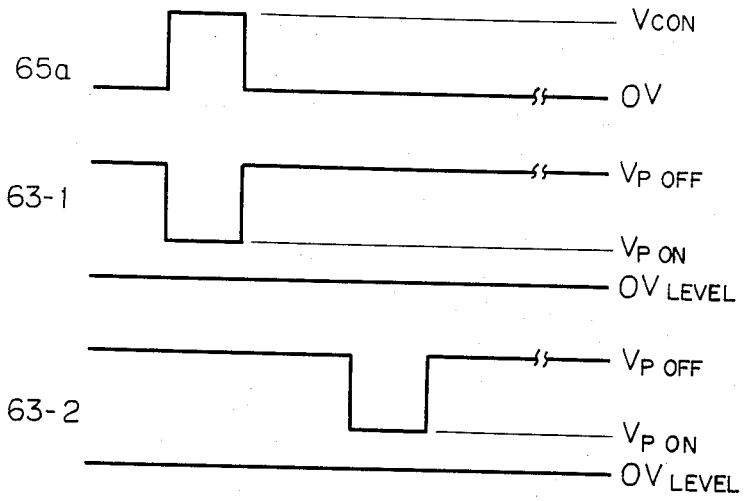
FIG. 10 is a timing chart showing a relationship between voltages which are applied to control control electrodes of FIG. 9 and recording electrodes when the control electrode is to be time-serially driven.

Referring to FIG. 9, a modification to the control electrodes 65 is shown. As shown, the control electrodes 65 are divided into a plurality of discrete blocks **65*a*, 65*b* and so on. Where the electrode blocks 65*a*, 65*b* . . . are time-serially driven, the control electrodes 65 and the recording electrodes 63 are applied with voltages as will be described with reference to FIG. 10**.

Assume that the control electrode **65*a* has been selected out of all such electrodes, and that a voltage $V_C$ has been applied to the selected electrode 65*a* with a zero volt applied to the others. In the meantime, a voltage $V_{P.ON}$ is applied as a pulse to a particular recording electrode 63-1 which is associated with a pixel to be recorded, and a voltage $V_{P.OFF}$ also as a pulse to a recording electrode 63-2 associated with any of the other pixels. Assuming that these volages are related as $V_{P.OFF} > V_{CON} > V_{P.ON} > 0$ volt, an electric field equivalent to the field $E_{ON}$ of FIG. 7 develops only in that bore 66 which is associated with the recording electrode 63 which corresponds to the pixel to be recorded. This electric field passes negative ions through the bore 66 toward the lower surface of the transfer member 5, thereby shifting the toner particles as previously discussed. In any of the conditions, i.e., control electrode O ($V_{CON}$) /recording electrode OFF ($V_{P.OFF}$), control electrode OFF (0 volt)/ recording electrode O ($V_{P.ON}$), and control voltage OFF (0 volt) / recording electrode OFF ($V_{P.OFF}$), the electric field developing in the bore 66 of the control plate 60 is equivalent to the field $E_{OFF}$ of FIG. 8 so that ony the positive ions are allowed to reach the transfer member 5**. therefore, even such a time-serial head drive offers a high quality image having a considerable S/N ratio.

To summarize the present invention described hereinabove, toner is carried by toner transport means and charged to a first polarity, while a transfer member is fed by feeding means to make contact with or come close to the toner layer on the transport means. Ion generating means is located at the opposite side to the charged toner layer with respect to the transfer member and generates ions having a second polarity which is opposite to the polarity of the toner or having both of a polarity common to that of the toner and a second polarity opposite to the same. The streams of ions are controlled pixel by pixel by ion stream control means responsive to image data which should be recorded, so that the toner particles are selectively deposited on the transfer member by coulomb force which acts between the ions and the charged toner.

The procedure described above allows a toner image to be directly formed on the transfer member and, thereby, significantly simplifies the process down to recording of an image on the transfer member, compared to that of the prior art. Also, it simplifies the apparatus construction to enhance reliability of operation and cut-down in size and cost. Furthermore, for each of those pixels which should not be recorded, ions opposite in polarity to the charged toner are applied to that surface of the transfer member which is opposite to the surface which makes contact with the charged toner, thereby freeing the background area of the transfer member from contamination to ensure high quality images with a high S/N ratio.

Various modifications will become possible for those skilled in the art after receiving the teachings of the present disclosure without departing from the scope thereof.

What is claimed is:

1. A recording apparatus for recording an image by controlling streams of ions pixel by pixel, comprising:

toner charging and transporting means for charging toner to a first polarity, regulating the charged toner to form a toner layer having a predetermined thickness, and transporting the charged toner layer;

ion generating means for generating ions having a predetermined polarity positioned at a side opposite to the charged toner layer with respect to a transfer member which is fed such that a surface of the transfer member is located close to or in contact with the charged toner layer; and ion stream control means for controlling streams of the ions generated by said ion generating means pixel by pixel responsive to image data which are to be recorded, whereby the charged toner is selectively deposited on the transfer member due to coulomb force acting between the ions having the predetermined polarity and the charged toner.

2. A recording apparatus as claimed in claim 1, wherein the predetermined polarity is a polarity opposite to the first polarity of the charged toner.

3. A recording apparatus as claimed in claim 1, wherein the predetermined polarity is a polarity common to the first polarity of the charged toner and a polarity opposite to the first polarity.

4. A recording apparatus as claimed in claim 1, wherein the ion generating means comprises a casing, a corona wire disposed in said casing for generating the ions, and a power source connected to said corona wire for applying a voltage of the predetermined polarity to the wire.

5. A recording apparatus as claimed in claim 4, wherein the predetermined polarity is a polarity opposite to the first polarity of the charged toner, the power source comprising a high-tension power source for applying a high voltage to the wire.

6. A recording apparatus as claimed in claim 4, wherein the predetermined polarity is a polarity common to the first polarity of the charged toner and a polarity opposite to the first polarity, the power source comprising an AC power source for applying a high voltage to the wire.

7. A recording apparatus as claimed in claim 6, wherein the power source further comprises a DC power source connected serially to the AC power source for applying to the wire a DC voltage of the first polarity superposing the DC voltage on the high voltage from the AC power source.

8. A recording apparatus as claimed in claim 1, wherein the ion stream control means comprises a plurality of recording power sources for generating a voltage responsive to image data which is to be recorded, a plurality of recording electrodes to which the voltage is applied from said recording power sources, a plurality of biase power sources for applying a predetermined bias voltage, and a plurality of control electrodes applied with the bias voltage for developing electric fields in cooperation with said recording electrodes for controlling the streams of ions, said recording electrodes and said control electrodes facing each other in one-to-one correspondence and provided with through bores through which the generated ions pass.

9. A recording apparatus as claimed in claim 8, wherein said bores are arranged one-dimensionally.

10. A recording apparatus as claimed in claim 9, wherein the bores are arranged linearly.

11. A recording apparatus as claimed in claim 9, wherein the bores are arranged in a zig-zag configuration.

12. A recording apparatus as claimed in claim 13, wherein the bores are arranged two-dimensionally.

13. A recording apparatus as claimed in claim 8, wherein the control electrodes are constructed integrally with each other.

14. A recording apparatus as claimed in claim 8, wherein the control electrodes are provided in a plurality of discrete blocks.

15. A recording apparatus as claimed in claim 14, wherein the ion stream control means operates such that the control electrodes and the recording electrodes are driven on a time-serial basis.

* * * * *